US008967773B2

(12) United States Patent
Suzuki et al.

(10) Patent No.: US 8,967,773 B2
(45) Date of Patent: Mar. 3, 2015

(54) LIQUID EJECTION HEAD AND METHOD OF MANUFACTURING LIQUID EJECTION HEAD

(75) Inventors: Toshio Suzuki, Sagamihara (JP); Ryota Kashu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/989,505

(22) PCT Filed: Dec. 7, 2011

(86) PCT No.: PCT/JP2011/006849

§ 371 (c)(1),
(2), (4) Date: May 24, 2013

(87) PCT Pub. No.: WO2012/086143

PCT Pub. Date: Jun. 28, 2012

(65) Prior Publication Data

US 2013/0242003 A1 Sep. 19, 2013

(30) Foreign Application Priority Data

Dec. 24, 2010 (JP) ..... 2010-288006
Nov. 10, 2011 (JP) ..... 2011-246454

(51) Int. Cl.
*B41J 2/045* (2006.01)
*B41J 2/14* (2006.01)
*B41J 2/055* (2006.01)

(52) U.S. Cl.
CPC ..... *B41J 2/14201* (2013.01); *B41J 2/055* (2013.01); *B41J 2/14209* (2013.01)
USPC ..... 347/68; 347/71

(58) Field of Classification Search
None
See application file for complete search history.

(56) References Cited

U.S. PATENT DOCUMENTS

| | | | | |
|---|---|---|---|---|
| 6,471,342 | B1 | 10/2002 | Horio et al. | |
| 2008/0117263 | A1 * | 5/2008 | Watanabe | 347/71 |
| 2012/0033015 | A1 | 2/2012 | Kashu et al. | |
| 2012/0113197 | A1 | 5/2012 | Kashu et al. | |
| 2013/0162725 | A1 | 6/2013 | Suzuki et al. | |

FOREIGN PATENT DOCUMENTS

| | | | |
|---|---|---|---|
| CN | 1249991 | A | 4/2000 |
| JP | H05-254132 | A | 10/1993 |
| JP | 06-98751 | B2 | 12/1994 |
| JP | H08-25627 | A | 1/1996 |

(Continued)

OTHER PUBLICATIONS

International Preliminary Report on Patentability dated Jun. 25, 2013, in International Application No. PCT/JP2011/006849.

(Continued)

*Primary Examiner* — Geoffrey Mruk
(74) *Attorney, Agent, or Firm* — Fitzpatrick, Cella, Harper & Scinto

(57) ABSTRACT

A liquid ejection head includes a plurality of ejection orifices which eject a liquid, a plurality of pressure chambers which store the liquid ejected from the ejection orifices and eject the liquid from the ejection orifices in accordance with expansion and contraction of an inner wall of the pressure chambers, and a plurality of recess portions which are formed around the pressure chambers, wherein a piezoelectric member is present between at least one of the recess portions and the pressure chambers.

20 Claims, 11 Drawing Sheets

(56) References Cited

FOREIGN PATENT DOCUMENTS

| | | | |
|---|---|---|---|
| JP | 2758633 | B2 | 5/1998 |
| JP | 2007-168319 | A | 7/2007 |

OTHER PUBLICATIONS

Office Action in Chinese Patent Application No. 201180056899.3, dated Aug. 4, 2014.

* cited by examiner

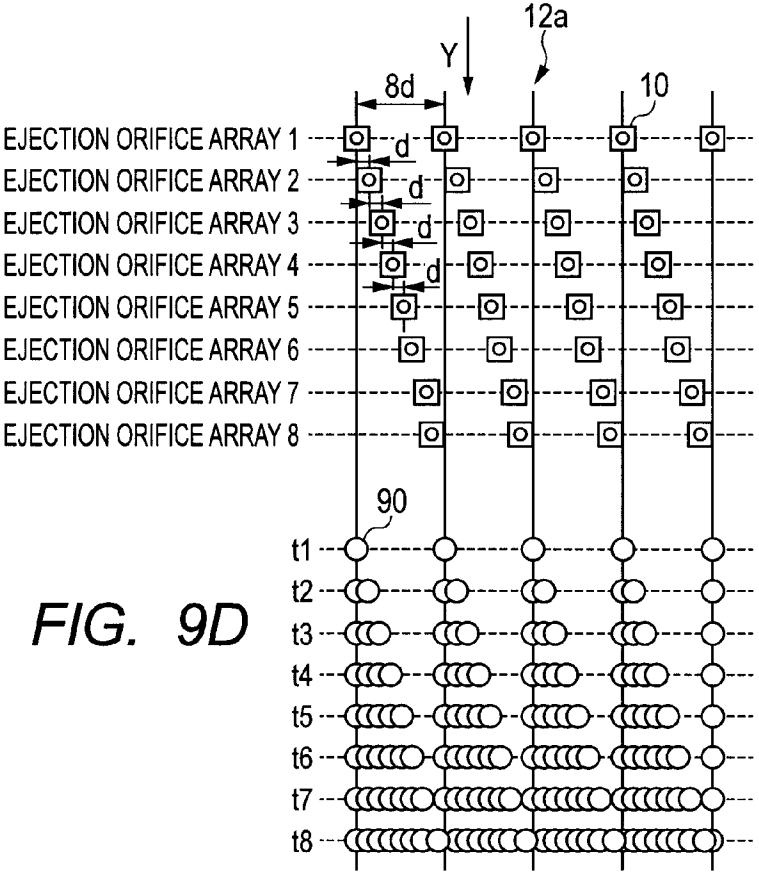
FIG. 9C
FIG. 9D
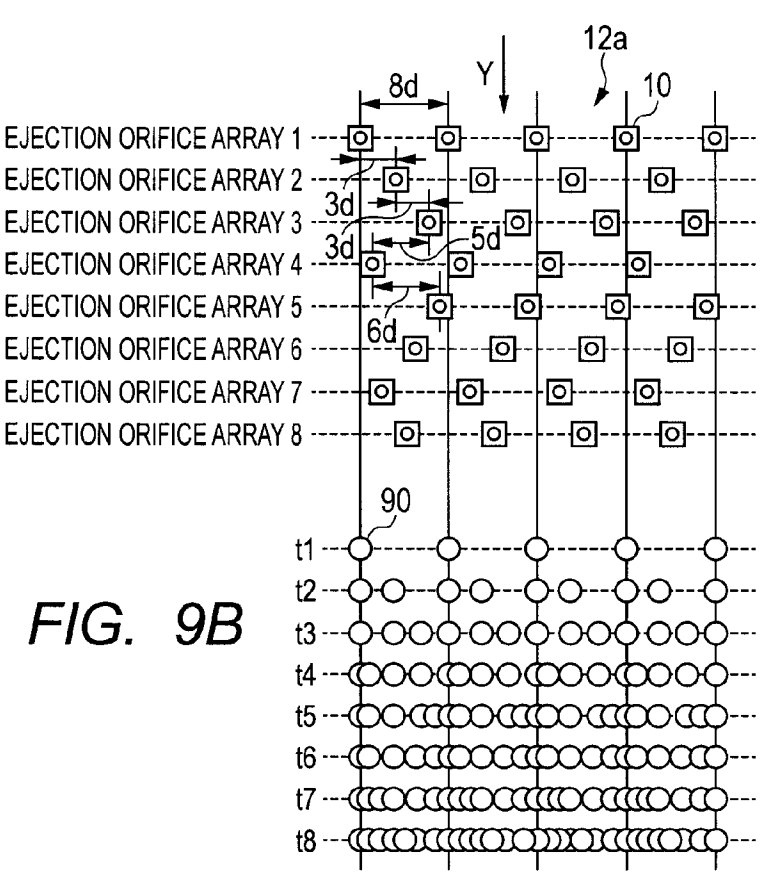
FIG. 9A
FIG. 9B

LIQUID EJECTION HEAD AND METHOD OF MANUFACTURING LIQUID EJECTION HEAD

TECHNICAL FIELD

The present invention relates to a liquid ejection head that ejects a liquid and a method of manufacturing the same.

BACKGROUND ART

In general, a liquid ejection head which ejects ink is mounted on an ink jet recording apparatus which records an image on a recording medium by ejecting ink thereto. As a mechanism which causes the liquid ejection head to eject ink, there is a known mechanism which uses a pressure chamber of which the volume can be shrunk by a piezoelectric element. In this mechanism, when the pressure chamber is shrunk by the deformation of the piezoelectric element to which a voltage is applied, the ink inside the pressure chamber is ejected from an ejection orifice which is formed in one end of the pressure chamber. As a liquid ejection head with such a mechanism, there is known a so-called shear mode type in which one or two inner wall surfaces of a pressure chamber are formed of a piezoelectric element and the pressure chamber is contracted by shearing the piezoelectric element through the application of a voltage thereto.

In an ink jet apparatus for industrial purpose, there is a demand for the use of a highly viscous liquid. In order to eject the highly viscous liquid, the liquid ejection head needs to have a larger ejection force. In order to meet such a demand, there is proposed a liquid ejection head which is called a so-called gourd type in which a pressure chamber is formed of a cylindrical piezoelectric member with a circular or rectangular cross-sectional shape. In the gourd type liquid ejection head, the pressure chamber can be expanded or contracted in such a manner that the piezoelectric member is uniformly deformed with respect to the center of the pressure chamber in the inward-outward direction (the radial direction). In the gourd type liquid ejection head, since all wall surfaces of the pressure chamber are deformed and the deformation contributes to the force of ejecting ink, it is possible to obtain a larger liquid ejecting force compared to the shear mode type in which one or two wall surfaces are formed of the piezoelectric element.

In the gourd type liquid ejection head, there is a need to arrange plural ejection orifices with higher density in order to obtain higher resolution. With such arrangement, there is a need to arrange the pressure chambers respectively corresponding to the ejection orifices with higher density. PTL 1 discloses a method of manufacturing a new gourd type liquid ejection head in which pressure chambers can be arranged with high density.

In the manufacturing method disclosed in PTL 1, first, plural grooves which extend in the same direction are formed in each of plurality piezoelectric plates. Subsequently, the plural piezoelectric plates are stacked with the directions of the grooves matched, and are cut in the direction perpendicular to the directions of the grooves. In the cut piezoelectric plate, the groove portion forms the inner wall surface of the pressure chamber. Subsequently, in order to separate the respective pressure chambers, the piezoelectric member present between the pressure chambers is removed up to a predetermined depth. The upper and lower portions of the piezoelectric plate with the completed pressure chambers are connected to a supply path plate, an ink pool plate, a printed circuit board, and a nozzle plate, thereby completely manufacturing the liquid ejection head. According to the manufacturing method disclosed in PTL 1, since the pressure chambers can be arranged in a matrix shape, the pressure chambers can be arranged with high density. Further, according to this manufacturing method, since the groove can be easily processed in the piezoelectric plate compared to the case of perforating the piezoelectric plate, it is considered that the pressure chamber can be formed with high precision.

In the liquid ejection head which is manufactured by the manufacturing method disclosed in PTL 1, the plural pressure chambers are arranged with a space interposed therebetween. For this reason, in particular, when the length (the height) of the pressure chamber is made to be long in order to eject a highly viscous liquid (in order to increase the force of ejecting a liquid), the rigidity of the liquid ejection head reduces. When the rigidity reduces, a liquid may not be ejected when the pressure chamber is folded.

CITATION LIST

Patent Literature

PTL 1: Japanese Patent Application Laid-Open No. 2007-168319

SUMMARY OF INVENTION

A liquid ejection head includes a plurality of ejection orifices which eject a liquid, a plurality of pressure chambers which store the liquid ejected from the ejection orifices and eject the liquid from the ejection orifices in accordance with expansion and contraction of an inner wall of the pressure chambers, and a plurality of recess portions which are formed around the pressure chambers, wherein a piezoelectric member is present between at least one of the recess portions and the pressure chambers.

Further features of the present invention will become apparent from the following description of exemplary embodiments with reference to the attached drawings.

BRIEF DESCRIPTION OF DRAWINGS

FIGS. 9A and 9B are diagrams illustrating a liquid ejection head of a second embodiment of the invention.

FIGS. 9C and 9D are diagrams illustrating a liquid ejection head of a second embodiment of the invention.

DESCRIPTION OF EMBODIMENTS

Figure 1:
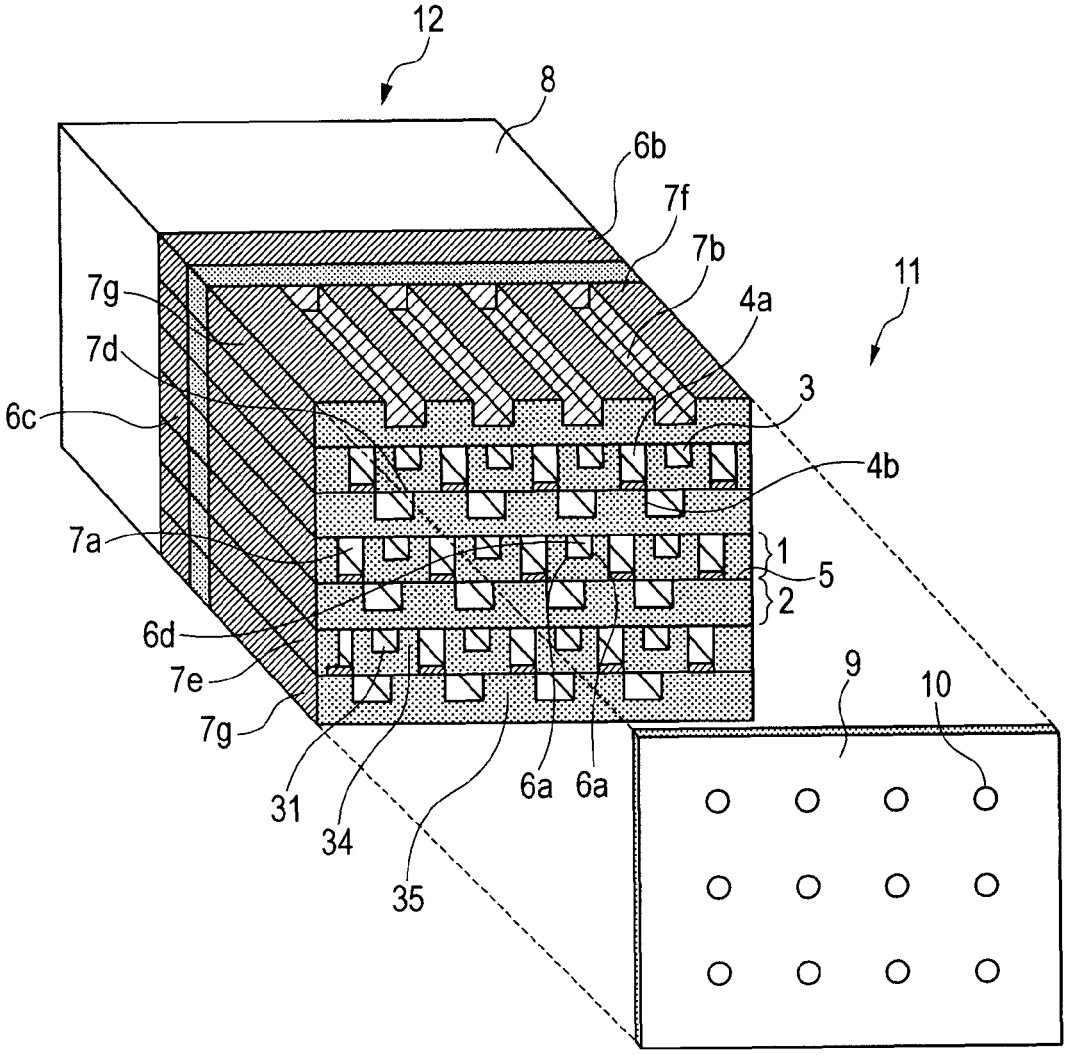
FIG. 1 is a perspective view showing the appearance of a liquid ejection head of a first embodiment of the invention.

Hereinafter, an example of embodiments of a liquid ejection head and a method of manufacturing the same of the invention will be described by referring to the drawings.

Furthermore, in first to fifth embodiments, a type of simultaneously driving all pressure chambers will be shown in order to simplify the description of the electrode interconnection.

First Embodiment

First, the structure of a liquid ejection head showing a first embodiment of the invention will be described. FIG. 1 is a perspective view showing the appearance of the liquid ejection head of the first embodiment of the invention.

As shown in FIG. 1, a liquid ejection head 12 of the embodiment includes an ink pool plate 8, a piezoelectric block unit 11, and a nozzle plate 9. The nozzle plate 9 is bonded to the front surface of the piezoelectric block unit 11. Furthermore, in FIG. 1, the piezoelectric block unit and the nozzle plate 9 are separated so that the structure of the piezoelectric block unit 11 is easily understood. The nozzle plate 9 is provided with plural ejection orifices 10 each being formed of a circular through-hole, and the ejection orifices 10 are arranged two-dimensionally with a predetermined interval therebetween. The ink pool plate 8 is bonded to the rear surface of the piezoelectric block unit 11.

Figure 2A:
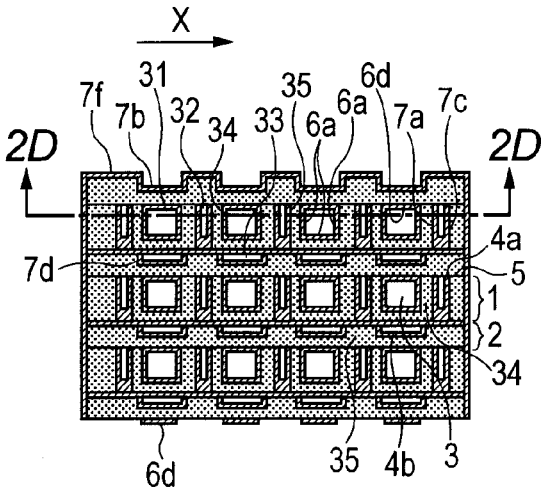
FIG. 2A is view showing the respective surfaces of a piezoelectric block unit shown in FIG. 1.
Figure 2B:
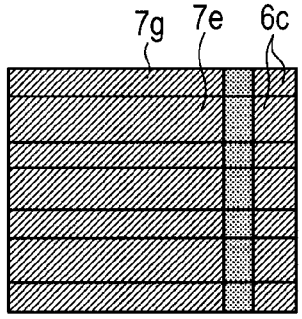
FIG. 2B is view showing the respective surfaces of a piezoelectric block unit shown in FIG. 1.
Figure 2C:
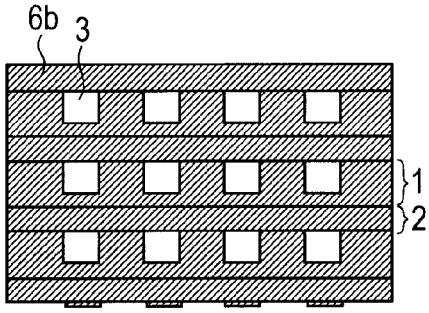
FIG. 2C is view showing the respective surfaces of a piezoelectric block unit shown in FIG. 1.
Figure 2D:
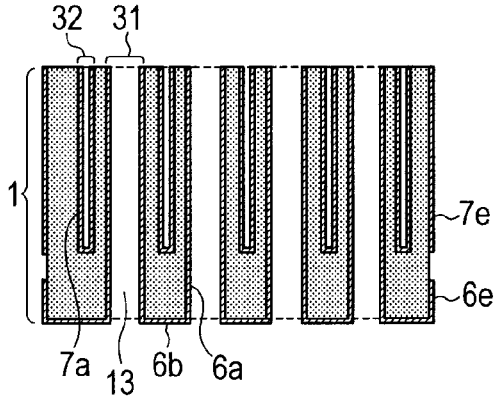
FIG. 2D is view showing the respective surfaces of a piezoelectric block unit shown in FIG. 1.

FIGS. 2A to 2D are views showing the respective surfaces of the piezoelectric block unit 11 shown in FIG. 1. FIG. 2A is a front view. FIG. 2B is a side view. FIG. 2C is a rear view. FIG. 2D is a cross-sectional view taken along the cutting line 2D-2D shown in FIG. 2A.

The piezoelectric block unit 11 is a layered unit in which a plate 1 (first plate) and a plate 2 (second plate) are alternately stacked with an adhesive layer 5 interposed therebetween. The plates 1 and 2 are also piezoelectric materials, and each plate 1 includes plural pressure chambers 3 which store a liquid and plural recess portions 4*a* (first recess portions). The pressure chambers 3 and the recess portions 4*a* are separated from each other by a piezoelectric member 34. Further, the plate 2 is provided with plural recess portions 4*b* (second recess portions), and the respective recess portions 4*b* are separated from each other by a piezoelectric member 35.

Each of the pressure chambers 3 includes a square pressure chamber opening 31 and a square passageway 13 (refer to FIG. 2D). The pressure chamber opening 31 is formed in the front surface of the plate 1 so as to face (communicate with) the ejection orifice 10. The opening diameter of the pressure chamber opening 31 is slightly larger than the opening diameter of the ejection orifice 10. The passageway 13 extends from the pressure chamber opening 31 so as to penetrate the inside of the plate 1 (refer to FIG. 2D).

As shown in FIG. 2A, the pressure chamber opening 31 is arranged so that plural pressure chamber opening arrays in each of which plural pressure chambers are arranged in one surface of the plate 1 with an interval (a first interval) interposed therebetween in a first direction X are arranged in a second direction intersecting the first direction X with an interval (a second interval) interposed therebetween. As shown in FIG. 2A, the recess portions 4*a* have openings 32 which are arranged alternately with the pressure chamber openings 31 in the first direction X (refer to FIG. 2D), and extend inside the plate 1 from the openings 32 so as to be parallel to the pressure chambers 3. Further, as shown in FIG. 2A, the recess portions 4*b* have openings 33 which are arranged alternately with the pressure chamber openings 31 in the second direction, and extend inside the plate 2 from the openings 33 so as to be parallel to the pressure chambers 3.

As shown in FIG. 2A, three surfaces of the inner wall of the pressure chamber 3 are provided with a first electrode 6*a*. As shown in FIGS. 2C and 2D, the first electrode 6*a* is connected to an electrode 6*b* which is formed in the rear surface of the plate 1. As shown in FIG. 2D, the electrode 6*b* is connected to an electrode 6*c* which is formed in the side surface of the plate 1.

The inner wall surface (the inner wall side) formed of the plate 2 in the pressure chamber 3 is provided with a first electrode 6*d*, which is connected to the electrode 6*a* formed in the plate 1. In the plate 2, the electrode 6*b* is formed in the rear surface, the electrode 6*c* is formed in the side surface, and the electrode 6*d* is connected to the electrodes 6*b* and 6*c*.

As shown in FIG. 2D, the inner wall surface (the inner wall side) of the recess portion 4*a* is provided with a second electrode 7*a*. The second electrode 7*a* is connected to an electrode 7*c* which is formed in the lower portion of the opening 32 (refer to FIG. 2A). The electrode 7*c* is connected to an electrode 7*d* which is formed in the lower surface of the plate 1. As shown in FIG. 2B, the electrode 7*d* is connected to an electrode 7*e* which is formed in the side surface of the plate 1. Furthermore, in the side surface of the piezoelectric plate 1, the electrode 7*e* is disposed so as to be spaced from the electrode 6*c*.

The inner wall surface (the inner wall side) of the recess portion 4*b* is provided with a second electrode 7*b*. The polarity of the second electrode 7*b* is the same as the polarity of the second electrode 7*a*, and is different from the polarity of the first electrode 6*a*. The second electrode 7*b* is connected to an electrode 7*f* (refer to FIG. 1) formed in the top surface of the plate 2. The electrode 7*f* is connected to an electrode 7*g* which is formed in the side surface of the plate 2 (refer to FIG. 1).

In the plate 1 and the plate 2 with the above-described structure, piezoelectric members 34 and 35 are subjected to a polarization treatment in advance from the inner wall surface of the pressure chamber 3 to the inner wall surfaces of the recess portions 4*a* and the recess portions 4*b*. For this reason, when a positive voltage is applied to the first electrodes 6*a* and 6*d* formed in the inner wall surface of the pressure chamber 3 and the second electrode 7*a* formed in the inner wall surface of the recess portions 4*a* and the second electrodes 7*b* and 7*d* formed in the inner wall surface of the recess portions 4*b* are grounded, the pressure chamber 3 is contracted. Accordingly, an ink which is introduced from the ink pool plate 8 to the pressure chamber 3 is ejected from the ejection orifices 10 through the pressure chamber openings 31.

According to the liquid ejection head 12 of this embodiment, the interval between the pressure chambers 3 is formed of the recess portions 4*a* and 4*b* and the piezoelectric members 34 and 35. For this reason, it is possible to increase the rigidity of the pressure chamber compared to the structure in which a space is interposed between the pressure chambers.

Next, referring to FIGS. 3A and 3B, 4A to 4D, 5, and 6 the process of manufacturing the liquid ejection head 12 will be described. Furthermore, here, the process of manufacturing the piezoelectric block unit 11 will be described in detail.

Figure 3A:
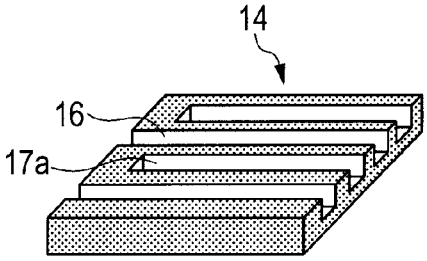
FIG. 3A is perspective view illustrating a groove formation process.
Figure 3B:
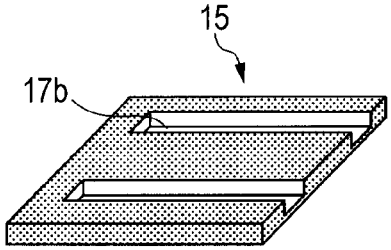
FIG. 3B is perspective view illustrating a groove formation process.

FIGS. 3A and 3B are perspective views illustrating a groove formation process. As shown in FIG. 3A, in the groove formation process, plural grooves 16 (first grooves) forming the inner wall surfaces of the respective pressure chambers 3 and plural grooves 17*a* (second grooves) forming the inner wall surfaces of the respective recess portions 4*a* are alternately formed in a piezoelectric material substrate 14 by dicing. The respective grooves 16 extend from one surface of the piezoelectric material substrate 14 to the opposite surface thereof, and one end of the grooves 16 forms the pressure chamber opening 31. The respective grooves 17*a* extend from one surface of the piezoelectric material substrate 14 so as to be parallel to the grooves 16, and are terminated inside the piezoelectric material substrate 14. Further, in the groove formation process, as shown in FIG. 3B, plural grooves 17*b* (third grooves) forming the inner wall surfaces of the respective recess portions 4*b* are formed in the piezoelectric material substrate 15 by dicing. The respective grooves 17*b* extend from one surface of the piezoelectric material substrate 15 in one direction, and are terminated inside the piezoelectric material substrate 15. When the groove formation process is completed, a plating process is performed.

Figure 4A:
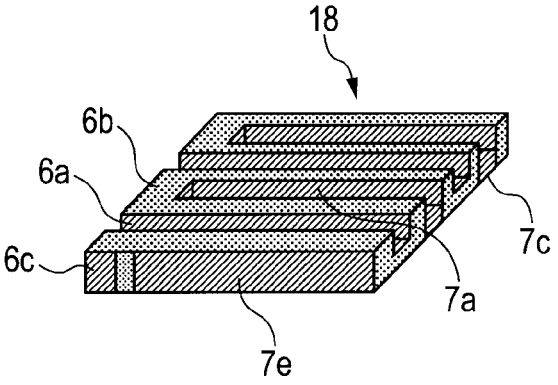
FIG. 4A is perspective view illustrating a plating process.
Figure 4C:
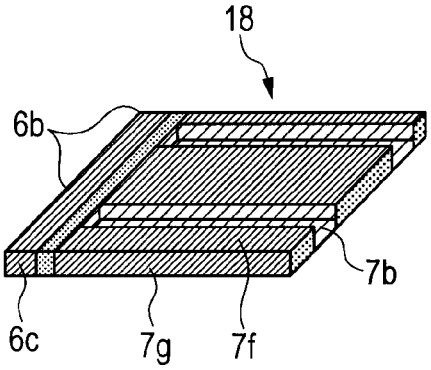
FIG. 4C is perspective view illustrating a plating process.
Figure 4B:
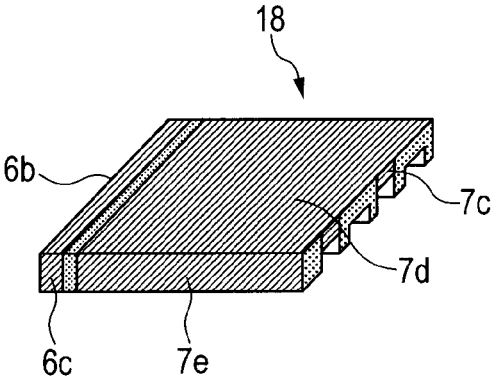
FIG. 4B is perspective view illustrating a plating process.
Figure 4D:
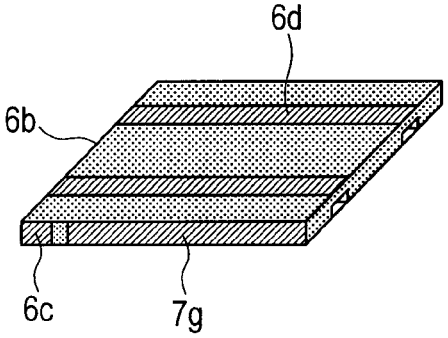
FIG. 4D is perspective view illustrating a plating process.

FIGS. 4A to 4D are perspective views illustrating the plating process. FIG. 4A is a perspective view showing the piezoelectric material substrate 14 from the front surface side, and FIG. 4B is a perspective view showing the piezoelectric material substrate 14 from the rear surface side. FIG. 4C is a perspective view showing the piezoelectric material substrate 15 from the front surface side, and FIG. 4D is a perspective view showing the piezoelectric material substrate 15 the rear surface side.

As shown in FIGS. 4A and 4B, in the plating process, selective plating 18 is performed on the front and rear surfaces of the piezoelectric material substrate 14. Accordingly, the first electrodes 6*a*, 6*b*, and 6*c*, the second electrode 7*a*, and the electrodes 7*c* to 7*e* which are described above are formed in the piezoelectric material substrate 14. Further, in the plating process, as shown in FIGS. 4C and 4D, selective plating 18 is also performed on the front and rear surfaces of the piezoelectric material substrate 15. Accordingly, the first electrodes 6*d*, 6*b*, and 6*c*, the second electrode 7*b*, the electrode 7*f*, and the electrode 7*g* are formed in the piezoelectric material substrate 15. When the plating process is completed, a polarization treatment process is performed so as to cause the piezoelectric block unit 11 to be such that the respective pressure chambers 3 are deformable to be contracted.

Figure 5:
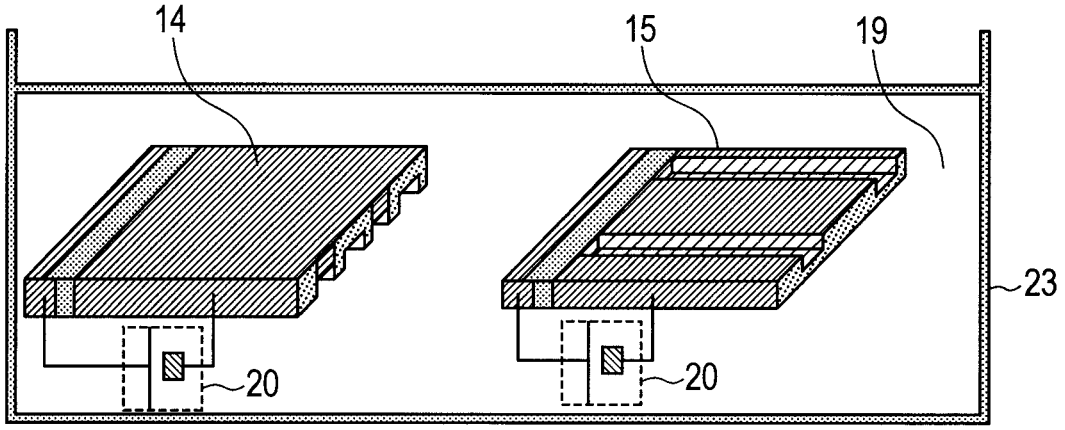
FIG. 5 is a perspective view illustrating a polarization treatment process.

FIG. 5 is a perspective view illustrating the polarization treatment process. As shown in FIG. 5, in the polarization treatment process, a 200 degree Celsius silicon oil 19 is inserted into a container 23, and 2 kV/ram of an electric field is applied from a power supply 20 to the piezoelectric material substrates 14 and 15, so that the piezoelectric material substrates 14 and 15 are polarized. As a result, the plate 1 and the plate 2 are completely manufactured. When the polarization treatment process is completed, the stacking process is performed.

Figure 6:
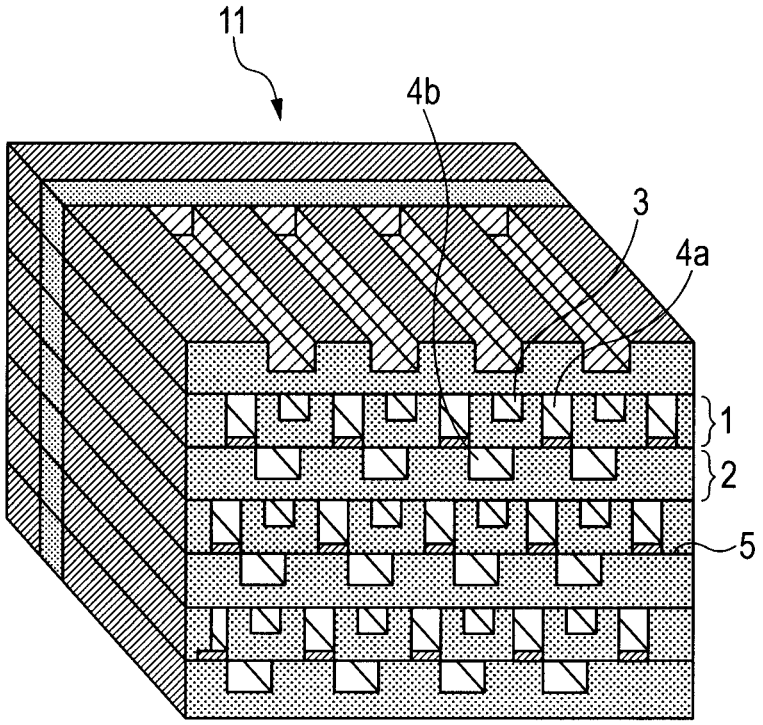
FIG. 6 is a perspective view illustrating a stacking process.

FIG. 6 is a perspective view illustrating the stacking process. As shown in FIG. 6, in the stacking process, plural plates 1 and plural plates 2 are alternately bonded to each other with an adhesive layer 5 interposed therebetween. Accordingly, the piezoelectric block unit 11 is completed. The nozzle plate 9 is bonded to the front surface of the completed piezoelectric block unit 11. Further, the ink pool plate 8 is bonded to the rear surface of the completed piezoelectric block unit 11. Accordingly, the liquid ejection head 12 is completed.

In the above-described manufacturing processes, the polarization treatment process is performed before the stacking process. This is because the adhesive used in the adhesive layer 5 requires heat resistance and electric-field resistance when the polarization treatment process is performed after the stacking process and the applicable adhesive is limited. In this embodiment, since the polarization treatment process is performed before the stacking process, it is possible to select a wide variety of adhesives which may be applied to the adhesive layer 5. Further, when the polarization treatment process is performed before the stacking process, since it is possible to perform the polarization treatment at the stage of a large substrate in the case where plural piezoelectric plates are produced from a single large substrate, this is advantageous for mass production.

Next, a simulation model for comparing the liquid ejection head 12 of this embodiment and the liquid ejection head of the comparative example and the simulation result will be described by referring to FIGS. 7A to 7C, 8A, and 8B. Furthermore, here, as the liquid ejection head of the comparative example, a conventional gourd type liquid ejection head with a space interposed between the pressure chambers and a wall driving shear mode type liquid ejection head famous for the industrial liquid ejection head are used. Further, the structure calculation simulator manufactured by ANSYS, Inc. is used.

Figure 7A:
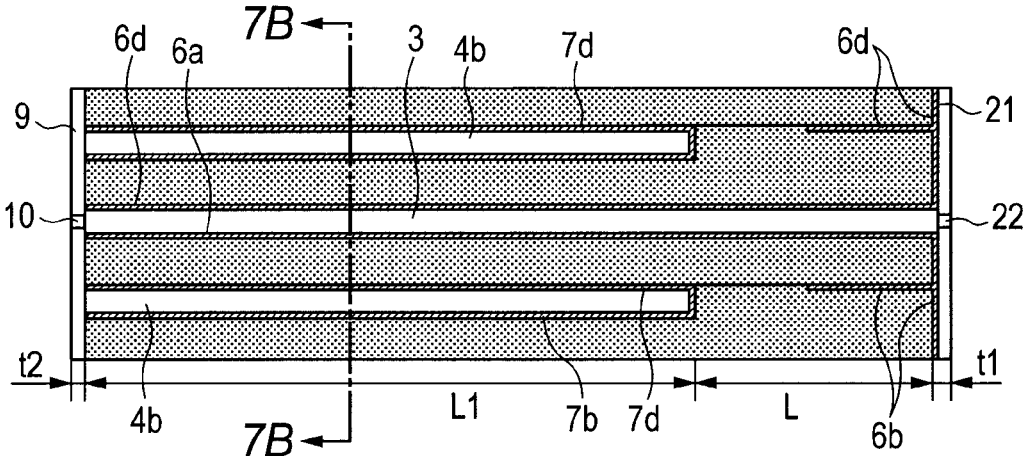
FIG. 7A is cross-sectional view showing a simulation model of a liquid ejection head.
Figure 7B:
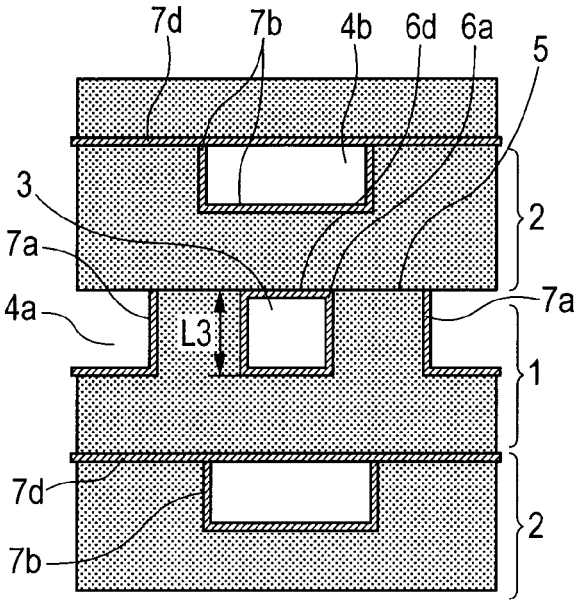
FIG. 7B is cross-sectional view showing a simulation model of a liquid ejection head.
Figure 7C:
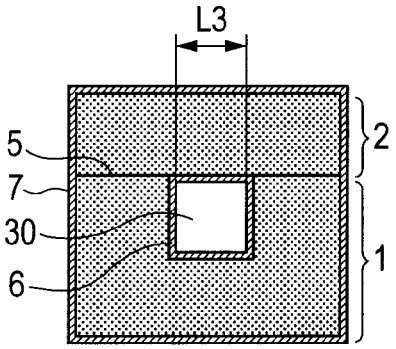
FIG. 7C is cross-sectional view showing a simulation model of a liquid ejection head.

FIG. 7A is the longitudinal cross-section of the simulation model of the liquid ejection head 12 of this embodiment. FIG. 7B is a cross-sectional view taken along the cutting line of 7B-7B shown in FIG. 7A. FIG. 7C is a cross-sectional view of the pressure chamber of the gourd type liquid ejection head which is one of the comparative examples.

In the simulation model shown in FIGS. 7A and B, a length L1 of the driving portion which contracts the pressure chamber 3 is set to 6 mm, and the simulation model includes a base portion which is provided in rear of the driving portion and has a length L2 of 5 mm. Further, the simulation model includes a diaphragm plate 21 which is provided in rear of the driving portion, has a thickness t1 of 0.22 mm, and is formed of silicon. The diaphragm plate 21 is provided with a diaphragm 22 of which the width is set to 0.03 mm, the height is set to 0.2 mm, and the length is set to 0.22 mm. Furthermore, as the materials of the piezoelectric plates 1 and 2, lead zirconate titanate (PZT) is used. Further, the nozzle plate 9 is affixed to the front side of the driving portion, the nozzle plate having the ejection orifice 10 with a diameter of 0.02 mm and a thickness t2 of 0.02 mm and being formed of stainless steel (SUS).

The cross-sectional area of the pressure chamber 30 shown in FIG. 7C is the same as the cross-sectional area of the pressure chamber 3 shown in FIG. 7B. The cross-sectional shape of each of the pressure chambers 3 and 30 is a square of which each edge L3 is 0.12 mm. The pressure chamber 3 and the pressure chamber 30 are different from each other depending on whether the outer periphery is restrained.

Regarding the dimension of the simulation model of the shear mode type liquid ejection head, the cross-section of the pressure chamber was set so that the width was 0.1 mm and the height was 0.2 mm, and the thickness of the driving wall was set to 0.07 mm.

Figure 8A:
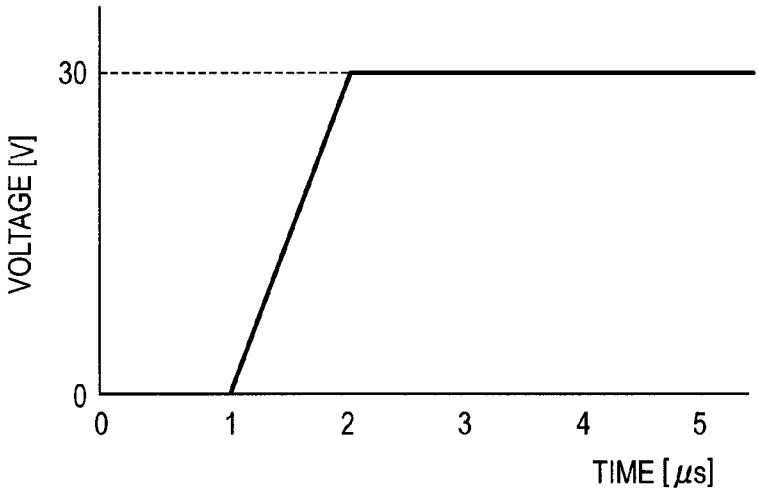
FIG. 8A is graph respectively showing a simulation voltage waveform and a simulation result.
Figure 8B:
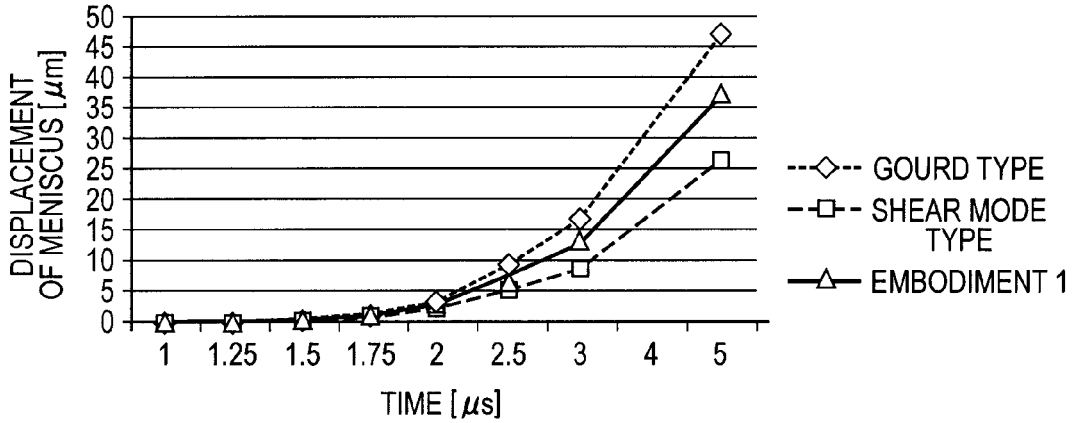
FIG. 8B is graph respectively showing a simulation voltage waveform and a simulation result.

FIG. 8A shows the voltage waveform for contracting the simulation model of the respective pressure chambers of this embodiment and the comparative example. As shown in the waveform shown in FIG. 8A, in this simulation, a +30 V voltage was applied to the inner wall surfaces of the respective pressure chambers for 1 to 2 microseconds. The viscosity of ink was set to 40 mPa·s. FIG. 8B shows a graph in which the meniscus displacement representing a variation in liquid surface in a nozzle portion over time is plotted in the vertical axis. The graph in FIG. 8B shows that the force of ejecting ink becomes larger as the meniscus displacement becomes larger when compared at the same time.

In the simulation result shown in FIG. 8B, the force of ejecting ink of the liquid ejection head of this embodiment is higher than that of the shear mode type, although being inferior to the gourd type of the comparative example. For this reason, the liquid ejection head of this embodiment has an ejection performance enough for ejecting highly viscous ink.

Second Embodiment

FIGS. 9A to 9D are schematic diagrams illustrating a liquid ejection head of a second embodiment of the invention. FIG. 9A is a layout diagram of the ejection orifices 10 of the liquid ejection head 12*a* of this embodiment. FIG. 9B is a diagram showing dots 90 of ink ejected from the ejection orifices 10 shown in FIG. 9A to the recording medium in accordance with the sequence of ejecting the ink. Further, FIG. 9C is a layout diagram of the ejection orifices 10 of the liquid ejection head 12 of the first embodiment. FIG. 9D is a diagram showing the dots 90 of the ink ejected from the ejection orifices 10 to the recording medium shown in FIG. 9C in accordance with the sequence of ejecting the ink.

In FIGS. 9A and 9C, the interval between the adjacent nozzles within the same array is 8*d*, and the dot interval formed by arranging eight arrays is thus d.

As shown in FIG. 9C, in the liquid ejection head 12 of the first embodiment, the centers of the ejection orifices 10 are deviated in the above-described first direction X in every ejection orifice array. For this reason, the length d of the deviation between two ejection orifice arrays which sequentially eject ink is constant. As a result, when ink is sequentially ejected from the respective ejection orifice arrays while the recording medium is transported in the transportation direction Y, the liquid ejection head 12 of the first embodiment sequentially forms the adjacent dots 90 as shown in FIG. 9D.

On the other hand, in the liquid ejection head 12*a* of this embodiment, as shown in FIG. 9A, the length of the deviation between two ejection orifice arrays which eject ink is different from the length of the deviation between the centers of different two ejection orifice arrays (so that they are not uniform). For example, the length of the deviation between the centers of the ejection orifices 31 present in the ejection orifice array 1 (the first ejection orifice array) and the ejection orifice array 2 (the second ejection orifice array) is 3*d*. On the contrary, the length of the deviation between the centers of the ejection orifices 10 in the ejection orifice array 3 and the ejection orifice array 4 (the fourth ejection orifice array) is 5*d*. For this reason, when the respective ejection orifice arrays sequentially eject ink while the recording medium is transported in the transportation direction Y, in the liquid ejection head 12*a* of this embodiment, as shown in FIG. 9B, the adjacent dots 90 are not continuously formed. Accordingly, in the liquid ejection head 12*a* of this embodiment, beading is not easily generated. Furthermore, in the manufacturing method disclosed in PTL 1, since the layered unit of the piezoelectric plate provided with the groove is cut in the direction perpendicular to the direction of the groove, the length of the deviation between the centers of the ejection orifices may not be changed every ejection orifice array as in this embodiment. Further, the beading mentioned herein indicates a phenomenon in which the concentration of ink is not constant because the next ink droplet is ejected before the first ejected ink droplet is absorbed to the recording medium, so that the ink droplets are mixed with each other to cause density unevenness.

Third Embodiment

Figure 10:
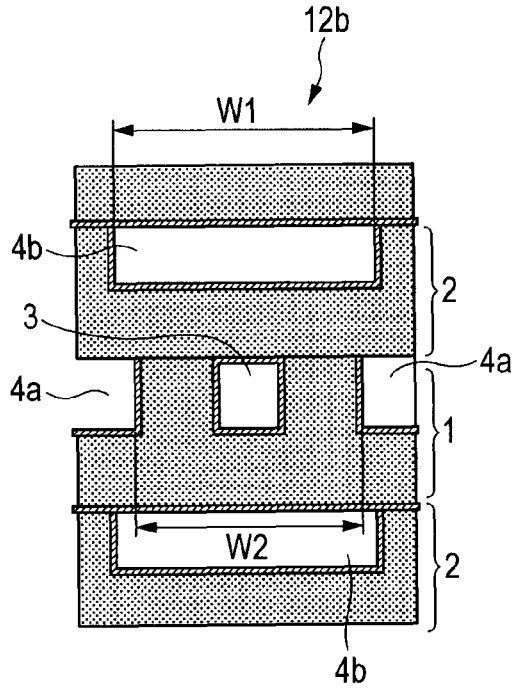
FIG. 10 is a front view showing the structure of a main part of a liquid ejection head of a third embodiment of the invention.

FIG. 10 is a front view showing the structure of a main part of a liquid ejection head of a third embodiment of the invention. In FIG. 10, the vicinity of the pressure chamber 3 of a liquid ejection head 12*b* of this embodiment is magnified. In the liquid ejection head 12*b* shown in FIG. 10, the shape of the recess portion 4*b* is different from that of the liquid ejection head 12 of the first embodiment. Specifically, in the liquid ejection head 12 of the first embodiment, as shown in FIG. 2A, the width of the recess portion 4*b* is narrower than the interval between the recess portions 4*a*. On the other hand, in the liquid ejection head 12*b* of this embodiment, the width W1 of the recess portion 4*b* is set to 0.48 mm, and the interval between the recess portions 4*a* with the pressure chamber 3 interposed therebetween is set to 0.36 mm. That is, the width W1 of the recess portion 4*b* is wider than the interval W2 between the recess portions 4*a*. For this reason, since the liquid ejection head 12*b* of this embodiment easily contracts the pressure chamber 3 compared to the liquid ejection head 12 of the first embodiment, the force of ejecting ink improves. Furthermore, since the liquid ejection head of this embodiment may be manufactured by widening the width of the groove 17*b* in the groove formation process described in the first embodiment, the manufacturing is not particularly difficult.

Fourth Embodiment

Figure 11:
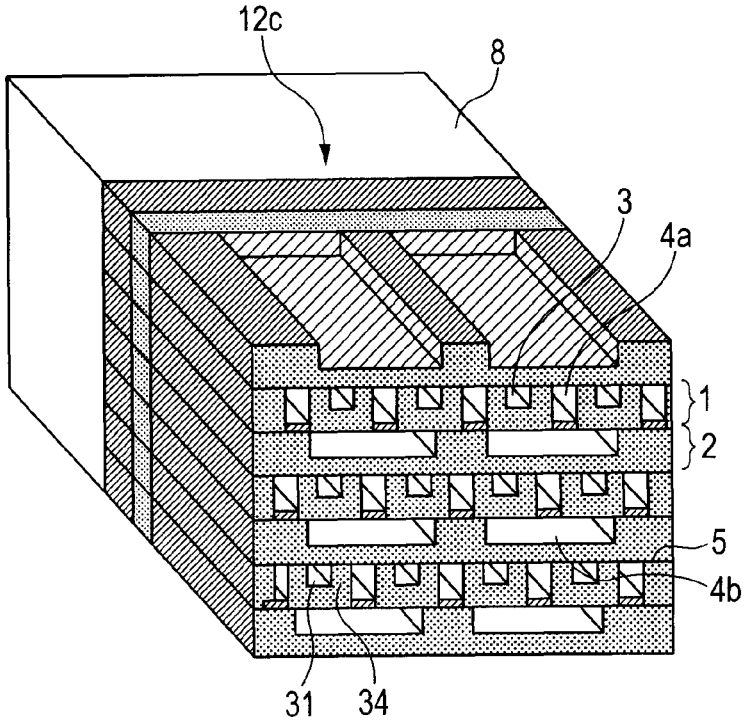
FIG. 11 is a perspective view showing the appearance of a liquid ejection head of a fourth embodiment of the invention.

FIG. 11 is a perspective view showing a liquid ejection head of a fourth embodiment of the invention. In a liquid ejection head 12*c* of this embodiment, the width of the recess portion 4*b* is much wider than that of the liquid ejection head 12*b* of the third embodiment. Specifically, in the liquid ejection head 12*b* of the third embodiment, one recess portion 4*b* is provided for each pressure chamber 3. On the other hand, in the liquid ejection head 12*c* of this embodiment, one recess portion 4*b* is provided for two pressure chambers 3. For this reason, since the liquid ejection head 12*c* of this embodiment can easily contract the pressure chamber 3 compared to the liquid ejection head 12*b* of the third embodiment, the force of ejecting ink further improves.

Fifth Embodiment

Figure 12:
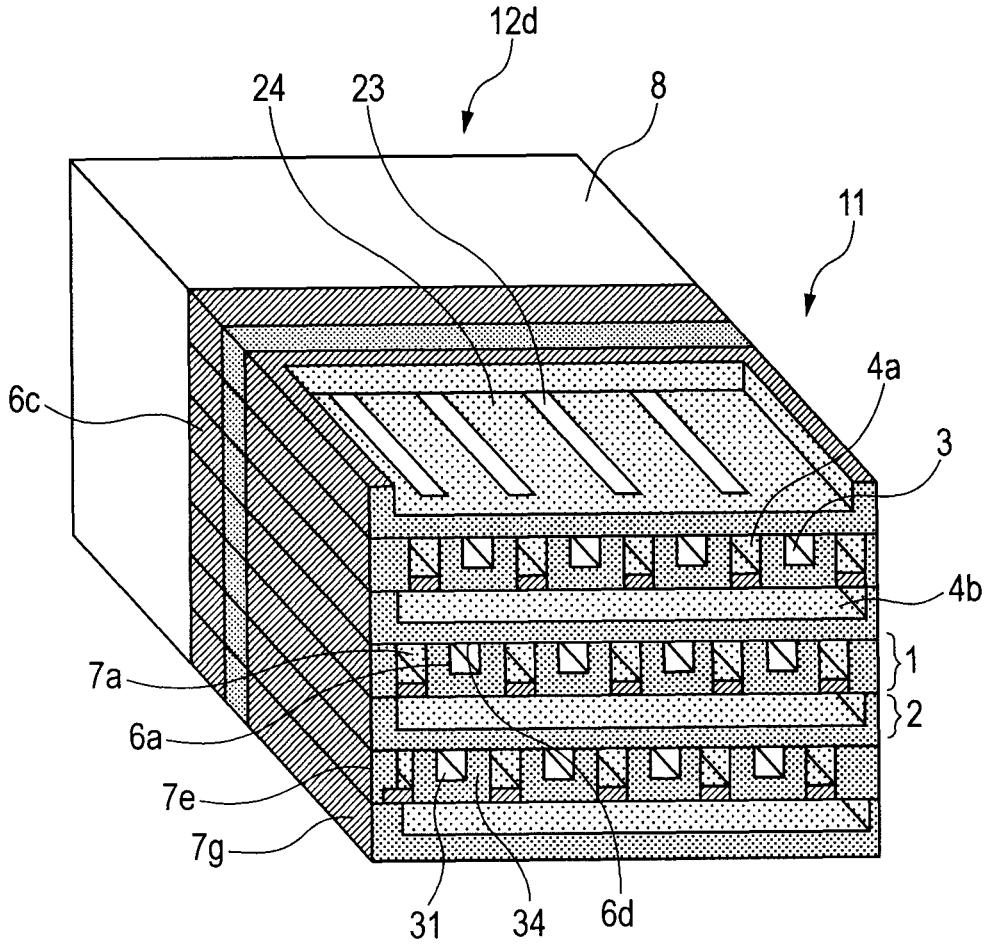
FIG. 12 is a perspective view showing the appearance of a liquid ejection head of a fifth embodiment of the invention.

FIG. 12 is a perspective view showing the appearance of a liquid ejection head of a fifth embodiment of the invention. In a liquid ejection head 12*d* of this embodiment, the shape of the recess portion 4*b* is different from the shape of the liquid ejection head 12 of the first embodiment. Specifically, in the liquid ejection head 12 of the first embodiment, as shown in FIG. 2A, the plate 2 is provided with plural recess portions 4*b*. On the other hand, in the liquid ejection head 12*d* of this embodiment, the plural recess portions 4*b* are connected so as to form a single recess portion 4*b* with a wide width. Furthermore, in the liquid ejection head 12*d* of this embodiment, a slit 23 which penetrates the recess portion 4*b* and the recess portion 4*a* is provided. The slit 23 is provided so as to cause insulation cooling oil 24 injected from the recess portion 4*b* of the uppermost layer to fill up to the recess portion 4*b* of the lowermost layer. By circulating the insulation cooling oil 24 inside the recess portions 4*a* and 4*b* in this way, the liquid ejection head 12*d* can be cooled.

Sixth Embodiment

Figure 13:
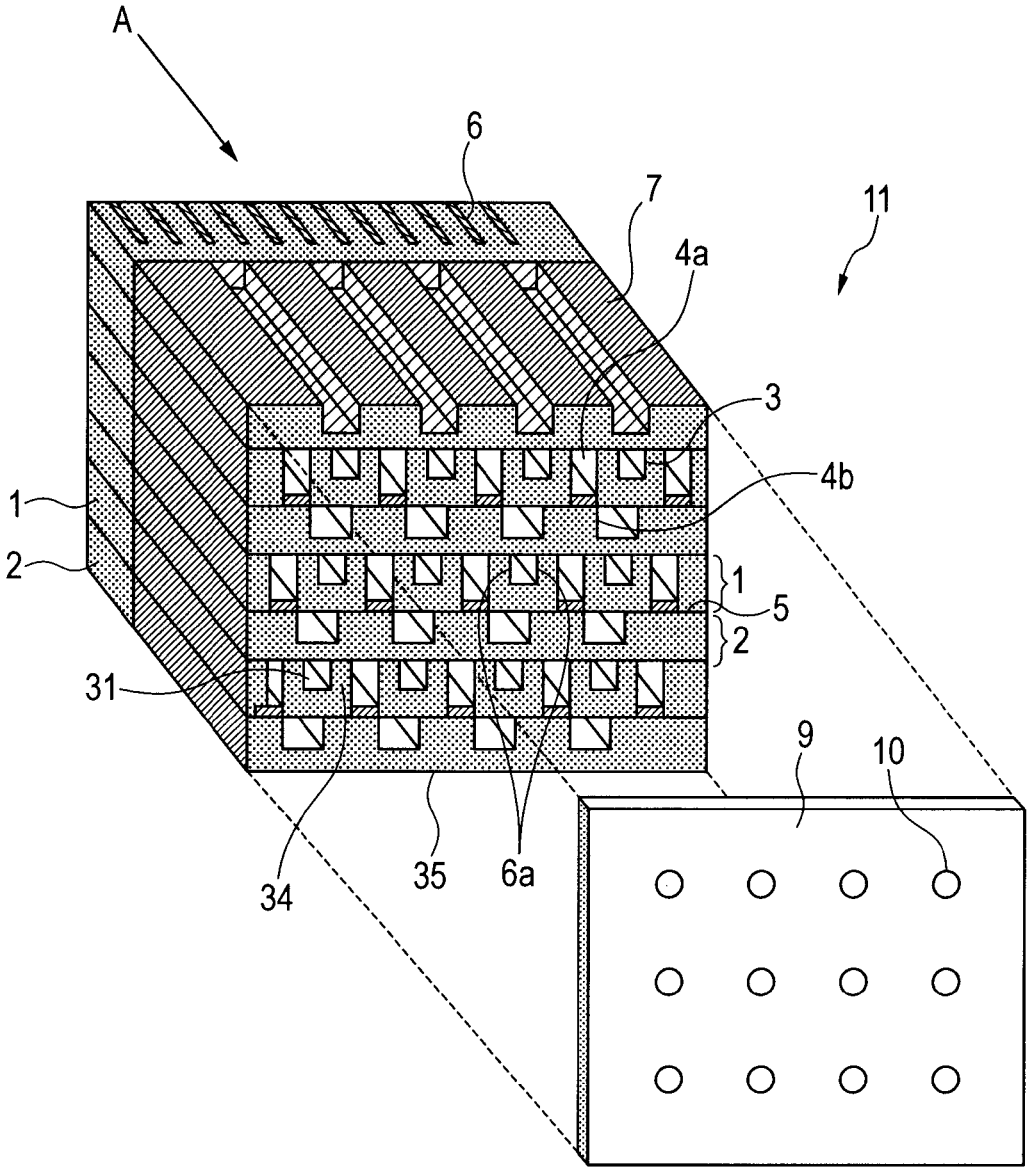
FIG. 13 is a perspective view showing the appearance of a liquid ejection head of a sixth embodiment of the invention.
Figure 14:
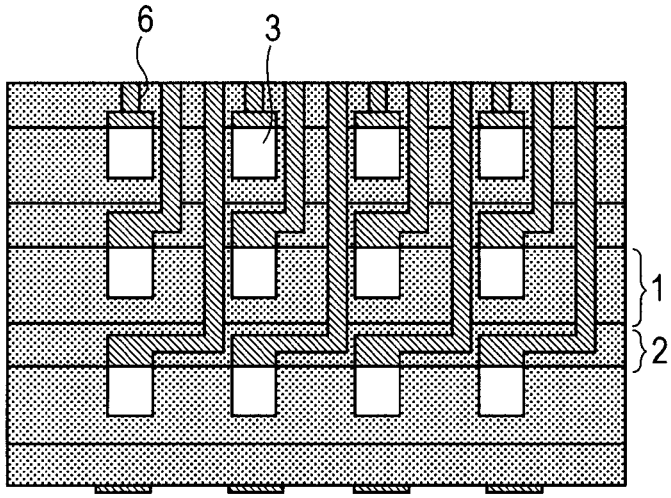
FIG. 14 is a view when seen from A of FIG. 13.

FIG. 13 is a perspective view showing an appearance of a liquid ejection head of a sixth embodiment of the invention, which is the same as that of the first embodiment except for the structure of the electrode wiring. The liquid ejection head of the invention shows a dot-on-demand type liquid ejection head which individually drives each pressure chamber. FIG. 14 is a perspective view when seen from A of FIG. 13. The electrode 6 and the first electrode 6*a* shown in FIG. 13 are electrically connected to each other so as to correspond to each other, thereby forming an individual electrode. The respective electrodes 6 extend upward from the inner wall of the pressure chamber 3 within the plane shown in FIG. 14, and are arranged on one side surface of the liquid ejection head 11 across the ridge line of the liquid ejection head 11 as shown in FIG. 13. A protective film is formed on the portion contacting ink in the electrode.

Seventh Embodiment

Figure 15:
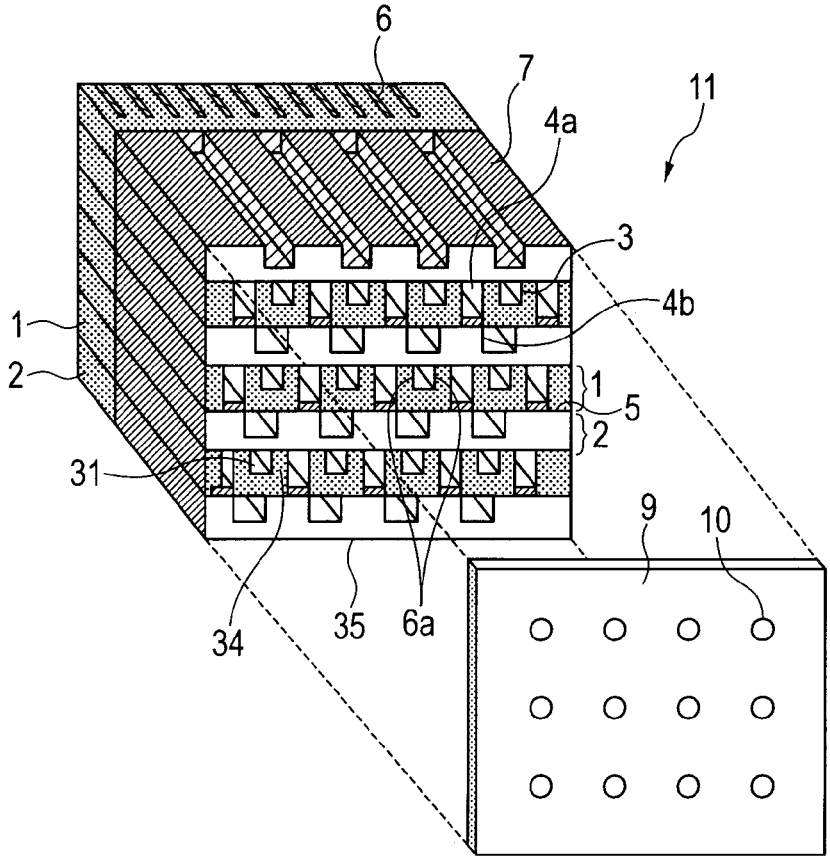
FIG. 15 is a perspective view showing the appearance of a liquid ejection head of a seventh embodiment of the invention.

FIG. 15 is a perspective view showing the appearance of a liquid ejection head of a seventh embodiment of the invention. The basic structure is the same as that of the sixth embodiment, but the material of the plate 2 is changed from the piezoelectric material to easy-machining ceramics. Since the top surface of the pressure chamber 3 is not the piezoelectric material, the driving surface is changed from four surfaces to three surfaces. However, since the easy-machining ceramics can be easily machined, be enough for mass production, and have high thermal conductivity, this is advantageous for preventing an increase in temperature of the head. Here, although three surfaces of the pressure chamber are configured to be driven, the member around the pressure chamber may be other than the piezoelectric material. Further, even when the member is formed of the piezoelectric material, only two surfaces or one surface may be configured to be driven by providing a surface which does not form the electrode.

As above, according to the respective embodiments of the invention, since the interval between the pressure chambers is formed of the member and the recess portion, it is possible to increase the rigidity of each pressure chamber compared to the structure in which a space is interposed between the pressure chambers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-288006, filed Dec. 24, 2010, and No. 2011-246454, filed Nov. 10, 2011 which are hereby incorporated by reference herein in their entirety.

The invention claimed is:

1. A liquid ejection head comprising:

an ejection orifice for ejecting a liquid;

a pressure chamber for storing the liquid to be ejected from the ejection orifice, the pressure chamber having a first electrode on an inner side surface thereof;

a piezoelectric material which constitutes a side wall of the pressure chamber and generates energy utilized for ejecting the liquid; and a plurality of openings which have a second electrode on an inner side surface thereof and are provided on both sides of the pressure chamber in each of a first direction and a second direction intersecting the first direction concerning a cross-section of the liquid ejection head passing through the pressure chamber in a direction intersecting a supply direction of the liquid which flows within the pressure chamber, wherein in the cross-section of the liquid ejection head, concerning the pressure chamber and the openings provided on both sides thereof in the first direction, the length of at least one of the openings in the second direction is longer than the length of the pressure chamber in the second direction.

2. The liquid ejection head according to claim 1, wherein a first substrate, in which a first groove forming part of the side wall of the pressure chamber and a second groove forming part of at least one of the openings are alternately formed in parallel, and a second substrate, in which a third groove forming part of at least one of the openings is formed in parallel, are laminated.

3. The liquid ejection head according to claim 2, wherein at least one of the first substrate and the second substrate is a piezoelectric material.

4. The liquid ejection head according to claim 1, wherein the side wall constituting the pressure chamber is polarized in a direction of connecting the first electrode provided on the inner side surface of the pressure chamber and the second electrode provided on the inner side surface of at least one of the openings.

5. The liquid ejection head according to claim 1, further comprising on one end side of the pressure chamber a nozzle plate in which the ejection orifice is formed.

6. The liquid ejection head according to claim 1, wherein a plurality of the ejection orifices are arranged along the first direction, and a plurality of the ejection orifices are arranged obliquely with respect to a direction perpendicular to the first direction.

7. The liquid ejection head according to claim 1, wherein the plurality of openings are supplied with a liquid for cooling the liquid ejection head.

8. The liquid ejection head according to claim 1, wherein in the cross-section of the liquid ejection head the pressure chamber has a rectangular cross-sectional shape.

9. The liquid ejection head according to claim 1, wherein in the cross-section of the liquid ejection head at least one of the openings has a rectangular cross-sectional shape.

10. The liquid ejection head according to claim 1, wherein in the cross-section of the liquid ejection head, concerning the pressure chamber and the openings provided on both sides thereof in the second direction, the length of at least one of the openings in the first direction is longer than the length of the pressure chamber in the first direction.

11. The liquid ejection head according to claim 1, wherein in the cross-section of the liquid ejection head, concerning the pressure chamber and the openings provided on both sides thereof in the first direction, the length of at least one of the openings in the first direction is shorter than the length of the pressure chamber in the first direction.

12. The liquid ejection head according to claim 1, wherein in the cross-section of the liquid ejection head, concerning the pressure chamber and the openings provided on both sides thereof in the second direction, the length of at least one of the openings in the second direction is shorter than the length of the pressure chamber in the second direction.

13. A liquid ejection head comprising:

an ejection orifice for ejecting a liquid;

a pressure chamber for storing the liquid to be ejected from the ejection orifice, the pressure chamber having a first electrode on an inner side surface thereof;

a piezoelectric material which constitutes a side wall of the pressure chamber and generates energy utilized for ejecting the liquid; and a plurality of openings which have a second electrode on an inner side surface thereof and are provided on both sides of the pressure chamber in each of a first direction and a second direction intersecting the first direction concerning a cross-section of the liquid ejection head passing through the pressure chamber in a direction intersecting a supply direction of the liquid which flows within the pressure chamber, wherein in the cross-section of the liquid ejection head, concerning the pressure chamber and the openings provided on both sides thereof in the second direction, the length of at least one of the openings in the first direction is longer than the length of the pressure chamber in the first direction.

14. The liquid ejection head according to claim 13, wherein a first substrate, in which a first groove forming part of the side wall of the pressure chamber and a second groove forming part of at least one of the openings are alternately formed in parallel, and a second substrate, in which a third groove forming part of at least one of the openings is formed in parallel, are laminated.

15. The liquid ejection head according to claim 14, wherein at least one of the first substrate and the second substrate is a piezoelectric material.

16. A liquid ejection head comprising:

an ejection orifice for ejecting a liquid;

a pressure chamber for storing the liquid to be ejected from the ejection orifice, the pressure chamber having a first electrode on an inner side surface thereof;

a piezoelectric material which constitutes a side wall of the pressure chamber and generates energy utilized for ejecting the liquid; and a plurality of openings which have a second electrode on an inner side surface thereof and are provided on both sides of the pressure chamber in each of a first direction and a second direction intersecting the first direction concerning a cross-section of the liquid ejection head passing through the pressure chamber in a direction intersecting a supply direction of the liquid which flows within the pressure chamber, wherein in the cross-section of the liquid ejection head, concerning the pressure chamber and the openings provided on both sides thereof in the first direction, the length of at least one of the openings in the first direction is shorter than the length of the pressure chamber in the first direction.

17. The liquid ejection head according to claim 16, wherein a first substrate, in which a first groove forming part of the side wall of the pressure chamber and a second groove forming part of at least one of the openings are alternately formed in parallel, and a second substrate, in which a third groove forming part of at least one of the openings is formed in parallel, are laminated.

18. The liquid ejection head according to claim 17, wherein at least one of the first substrate and the second substrate is a piezoelectric material.

19. A liquid ejection head comprising:

an ejection orifice for ejecting a liquid;

a pressure chamber for storing the liquid to be ejected from the ejection orifice, the pressure chamber having a first electrode on an inner side surface thereof;

a piezoelectric material which constitutes a side wall of the pressure chamber and generates energy utilized for ejecting the liquid; and a plurality of openings which have a second electrode on an inner side surface thereof and are provided on both sides of the pressure chamber in each of a first direction and a second direction intersecting the first direction concerning a cross-section of the liquid ejection head passing through the pressure chamber in a direction intersecting a supply direction of the liquid which flows within the pressure chamber, wherein in the cross-section of the liquid ejection head, concerning the pressure chamber and the openings provided on both sides thereof in the second direction, the length of at least one of the openings in the second direction is shorter than the length of the pressure chamber in the second direction.

20. The liquid ejection head according to claim 18, wherein a first substrate, in which a first groove forming part of the side wall of the pressure chamber and a second groove forming part of at least one of the openings are alternately formed in parallel, and a second substrate, in which a third groove forming part of at least one of the openings is formed in parallel, are laminated.

* * * * *